United States Patent [19]

Meglino

[11] Patent Number: 4,836,505

[45] Date of Patent: Jun. 6, 1989

[54] SLAT RETAINING MEANS FOR CHAIN LINK FENCES

[76] Inventor: Don A. Meglino, 85 Edwards St., Roslyn Heights, N.Y. 11577

[21] Appl. No.: 921,398

[22] Filed: Oct. 22, 1986

[51] Int. Cl.[4] ..... B21F 27/00

[52] U.S. Cl. ..... 256/34; 256/22; 256/35; 245/11

[58] Field of Search ..... 256/34, 22, 35; 245/11

[56] References Cited

U.S. PATENT DOCUMENTS

| | | | |
|---|---|---|---|
| 304,630 | 9/1884 | Eaton | 256/34 |
| 2,020,379 | 11/1935 | Ruppel | 256/34 |
| 2,802,645 | 8/1957 | Rice | 256/34 |
| 4,085,954 | 4/1978 | Thompson | 256/34 |
| 4,512,556 | 4/1985 | Meglino | 256/34 |

*Primary Examiner*—Andrew V. Kundrat

[57] ABSTRACT

Slat retainer for chain link fences of the type having a plurality of parallel slats woven through the fence wires. A strip member extends across the slats and is connected to each of the slats. The strip member preferably extends across the top area of the slats. A cover is mounted over the top of the slats and the strip.

1 Claim, 1 Drawing Sheet

SLAT RETAINING MEANS FOR CHAIN LINK FENCES

TECHNICAL FIELD

This invention relates to slats for chain link fences and more particularly for means for retaining the slats in position in the chain link fence.

BACKGROUND

This application is an improvement over my prior U.S. Pat. No. 4,512,556, dated Apr. 3, 1985, of the same title.

Slats are commonly used in chain link fences for providing privacy and enhancing the appearance of the fences. A major problem is retaining the slats in position so that they do not slide down and possibly fall out of the fence.

My prior patent has one solution, namely, inserting a cross piece through the slats. This involves cutting apertures in the slats which is expensive, time consuming operation. Another method used is to form knuckles or projection in the lower wires tohold the slats in place. However, this is difficult in the weaving operation of the chain link fencing.

THE INVENTION

The invention provides means for retaining slats in a chain link fence comprising strips extending across the slats and connected to each of them.

The strip is preferably mounted across the top of the slats so that it can be covered by a cover.

OBJECTS OF THE INVENTION

Accordingly, a principal object of the invention is to provide new and improved means for retaining slats in chain link fences.

Another object of the invention is to provide new and improved slat retaining means comprising a strip member extending across the slats and connected to each slat.

Another object of the invention is to provide new and improved slat retaining means comprising a strip member extending across the slats and connected to each slat wherein the strip member is mounted along the top portion of the slats.

Another object of the invention is to provide new and improved slat retaining means comprising a strip member extending across the slats and connected to each slat wherein the strip member is mounted along the top portion of the slats and a cover covering said strip member.

BEST MODE OF THE INVENTION

Referring to the Figures, a plurality of slats, 1, 2,3, etc., extend through the wires 4, 5, 6, etc., of the chain link fence. A strip member 7 extends across the slats 1, 2, 3, etc., and is fastened to each slat by conventional means, for instance, by screws, rivets, electronic sealing if the slats and strips are of plastic or other conventional methods.

The slats will be held from dropping out or falling out because the strip comes in contact with the upper ends of the wires, for instance, wire 6, and this will prevent the slats from slidng down and possibly falling out of the chain link fencing.

Figure 1:
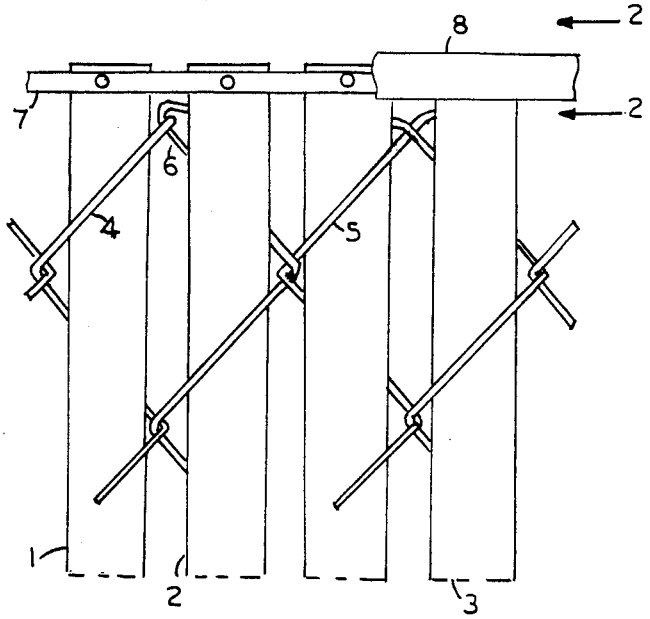
FIG. 1 is a front view of an embodiment of the invention.

The strip 2 is preferably mounted along the top of the slats as shown in FIG. 1 because this is a convenient place to apply the strip member 2 and also permits the strip member to be covered by the cover 8 which may slide over the strip member.

The slats may be formed of conventional material, such as wood, metal, extruded plastic or equivalents. The strip member may also be made of any conventional materials, such as, wood, metal or extruded plastic.

Figure 2:
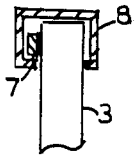
FIG. 2 is a view partly in section taken along the lines 2—2 of FIG. 1.

The cover may be made of any conventional material but is preferably made as an extruded plastic member and it is formed to slide over the strip and the top of the slats as shown in FIG. 2 with a friction fit. It may also be separately fastened to the slats, if desired.

It is claimed:

1. Slat retaining means for chain link fences of the type having a plurality of parallel slats woven through the fence wires, a strip member extending across said slats and means connecting said strip member to each of said slats, wherein the strip member extends across the top area of the slats, and a cover mounted over the top of the slats and the strip.

* * * * *